US008737647B2

(12) United States Patent
Fujiki

(10) Patent No.: US 8,737,647 B2
(45) Date of Patent: May 27, 2014

(54) DISPLAY

(75) Inventor: Gen Fujiki, Tokyo (JP)

(73) Assignee: Sony Corporation, Tokyo (JP)

( * ) Notice: Subject to any disclaimer, the term of this patent is extended or adjusted under 35 U.S.C. 154(b) by 835 days.

(21) Appl. No.: 12/330,065

(22) Filed: Dec. 8, 2008

(65) Prior Publication Data

US 2009/0147974 A1 Jun. 11, 2009

(30) Foreign Application Priority Data

Dec. 10, 2007 (JP) ..... P2007-317957

(51) Int. Cl.
*H04R 5/02* (2006.01)
*A47B 5/00* (2006.01)

(52) U.S. Cl.
USPC ..... 381/306; 381/300; 381/61; 381/388; 381/377; 381/182; 312/7.2; 348/432.1; 348/836; 348/462

(58) Field of Classification Search
CPC ..... H04R 5/00; H04R 5/02; H04R 2205/00; H04R 2205/021; H04R 2499/15; H04S 3/002; H04S 3/008; H04S 2400/01
USPC ..... 381/345, 386, 388, 89, 91, 152, 182, 381/300, 330, 333, 17, 18, 61, 27, 301, 306, 381/87, 332, 377, 387; 312/7.2; 348/423.1, 348/462, 515, 836
See application file for complete search history.

(56) References Cited

U.S. PATENT DOCUMENTS

| | | | | |
|---|---|---|---|---|
| 5,588,063 | A * | 12/1996 | Edgar | 381/300 |
| 6,366,706 | B1 * | 4/2002 | Weitbruch | 382/254 |
| 6,533,063 | B1 | 3/2003 | Ikeuchi et al. | |
| 7,158,642 | B2 * | 1/2007 | Tsuhako | 381/27 |
| 2005/0047617 | A1 * | 3/2005 | Lee | 381/306 |
| 2005/0264766 | A1 * | 12/2005 | Morimoto et al. | 353/61 |
| 2006/0044419 | A1 * | 3/2006 | Ozawa | 348/231.99 |
| 2006/0061687 | A1 * | 3/2006 | Dunton | 348/564 |
| 2007/0097261 | A1 * | 5/2007 | Smith et al. | 348/445 |
| 2008/0048552 | A1 * | 2/2008 | Ito et al. | 313/496 |
| 2008/0102743 | A1 * | 5/2008 | Williams | 454/56 |

FOREIGN PATENT DOCUMENTS

| | | |
|---|---|---|
| JP | 11 338438 | 12/1999 |
| JP | 2000 59881 | 2/2000 |
| JP | 2001 282113 | 10/2001 |
| JP | 2003 164000 | 6/2003 |

* cited by examiner

*Primary Examiner* — Cuong Q Nguyen
*Assistant Examiner* — Galina Yushina
(74) *Attorney, Agent, or Firm* — Sony Corporation of America

(57) ABSTRACT

A display, includes: a display section; a first output section; a second output section; and a housing containing the display section, the first output section, and the second output section, wherein, the display section has an aspect ratio with a width more than twice a height, the first output section is arranged along an upper side of the display section so as to face forward and is configured to output a plurality of channels of audio, and the second output section is arranged along a lower side of the display section so as to face forward and is configured to output a plurality of channels of audio.

9 Claims, 6 Drawing Sheets

RELATED ART

DISPLAY

CROSS REFERENCES TO RELATED APPLICATIONS

The present invention contains subject matter related to Japanese Patent Application JP 2007-317957, filed in the Japan Patent Office on Dec. 10, 2007, the entire contents of which being incorporated herein by reference.

BACKGROUND OF THE INVENTION

1. Field of the Invention

The present invention relates to a display. In particular, the present invention relates to a display that enables a user to experience an ambience with improved realism.

2. Description of the Related Art

Many television receivers have loudspeakers arranged on left and right sides thereof to enable their users to enjoy stereophonic sound. Thus, the users are able to listen to two channels of audio, with one channel for the left side and the other for the right side, so that the users can enjoy sound with improved realism.

For example, JP-A-Hei 6-35489 describes a technique of preparing a center channel in addition to the left and right channels to achieve a total of three channels, allowing an audio of the center channel to be outputted via loudspeakers arranged at upper and lower positions on a television receiver, and placing acoustic lenses in front of the center-channel loudspeakers to localize an acoustic image.

SUMMARY OF THE INVENTION

However, even with the structure of the above technique, it is difficult to enable the user to experience an ambience with a great sense of realism.

The present invention addresses the above-identified, and other problems associated with existing methods and apparatuses, and enables the user to experience an ambience with improved realism.

According to one embodiment of the present invention, there is provided a display including: a display section; a first output section; a second output section; and a housing containing the display section, the first output section, and the second output section. The display section has an aspect ratio with a width more than twice a height. The first output section is arranged along an upper side of the display section so as to face forward and is configured to output a plurality of channels of audio. The second output section is arranged along a lower side of the display section so as to face forward and is configured to output a plurality of channels of audio.

According to one embodiment of the present invention, a housing of a display includes a display section, a first output section, and a second output section. The display section has an aspect ratio with a width more than twice a height. The first output section is arranged along an upper side of the display section so as to face forward and is configured to output a plurality of channels of audio. The second output section is arranged along a lower side of the display section so as to face forward and is configured to output a plurality of channels of audio.

As described above, according to one embodiment of the present invention, it is possible to enable a user to experience an ambience with improved realism.

DETAILED DESCRIPTION OF THE PREFERRED EMBODIMENTS

Hereinafter, an embodiment of the present invention will be described with reference to the accompanying drawings.

Figure 1:
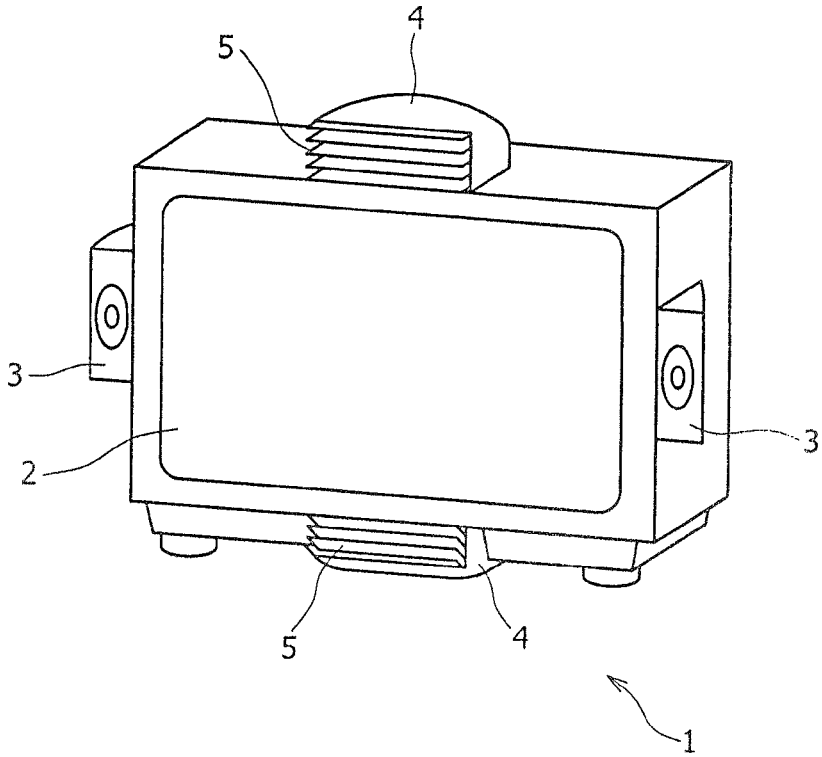
FIG. 1 is a perspective view illustrating a structure of a known television receiver.
Figure 2:
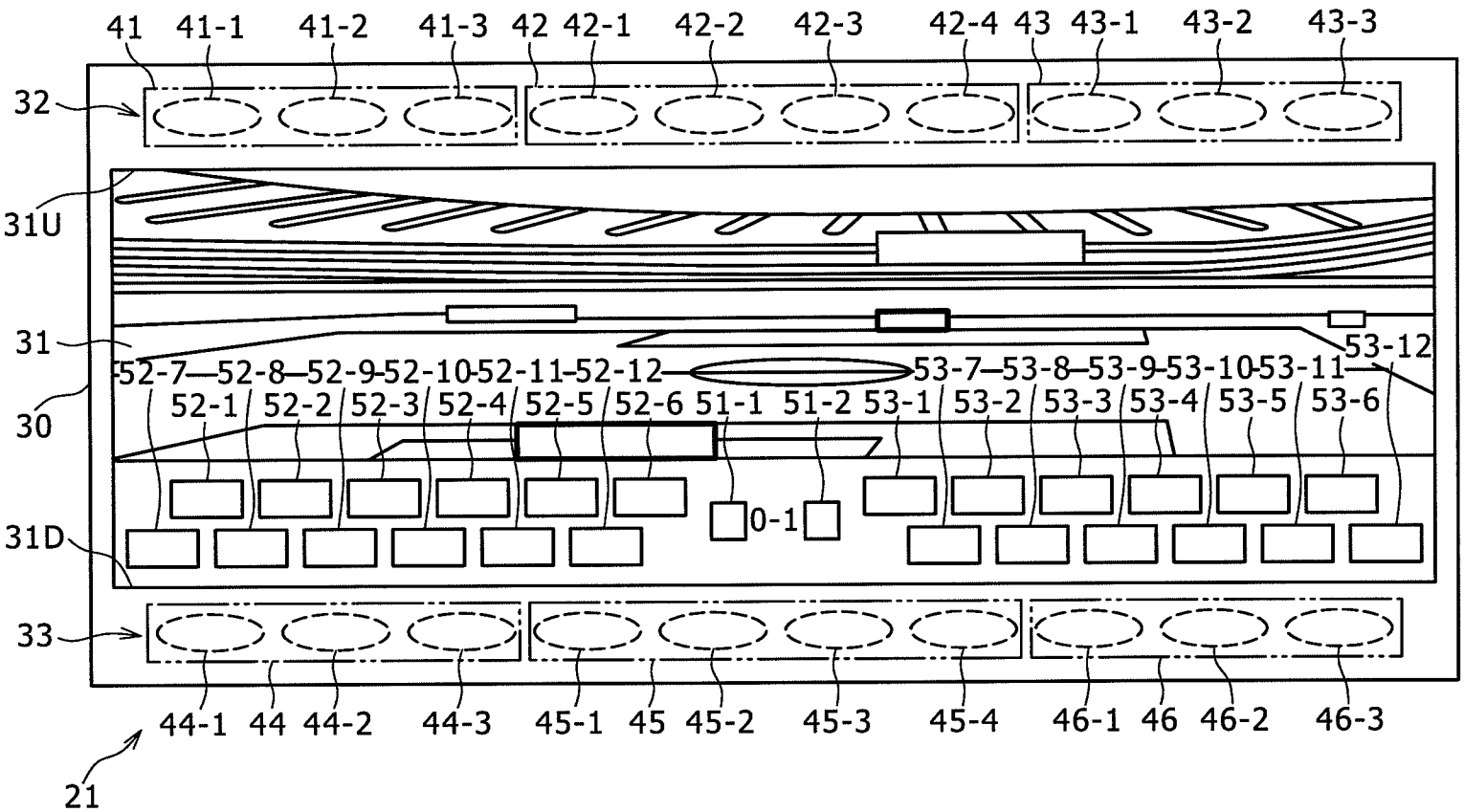
FIG. 2 is a front view illustrating a structure of a display according to one embodiment of the present invention.

FIG. 2 illustrates the structure of a front of a display 21 according to one embodiment of the present invention. As shown in FIG. 2, the display 21 according to this embodiment is a slim display, and has a housing 30 that contains a display section 31, a first output section 32, and a second output section 33.

The display section 31 is arranged at approximately the middle of the housing 30. The display section 31 has an aspect ratio with a width more than twice a height. The display section 31 may be formed by a liquid crystal display, a plasma display, or an organic electroluminescence (EL) display, for example.

In the case of a high-definition television system, the aspect ratio is 16:9. This system provides more powerful images than an NTSC system with an aspect ratio of 4:3, but the images provided by the high-definition television system are not powerful enough to enable a user to feel a great sense of realism. Accordingly, in the present embodiment, "Scope size" having an aspect ratio with the width more than approximately twice the height, as typified by CinemaScope® movie, is adopted.

Thus, in the case where a broadcast video of a soccer game is displayed, for example, it is possible to display not only images showing spectators perform a wave in a stadium but also images showing other spectators watching the wave at the same time. Accordingly, the user is able to choose images that he or she desires to focus his or her attention on from among all images displayed on the display section 31, so that the user can experience images with improved realism.

In addition, the display section 31 is capable of displaying an image based on subordinate information such as metadata. For example, while main images showing the development of the game played in the soccer stadium are displayed on the display section 31, the following is displayed below the main images: current scores "0-1"; an emblem image 51-1 of a team having a score of 0; thumbnail images 52-1 to 52-12 of players on this team; an emblem image 51-2 of a team having a score of 1; thumbnail images 53-1 to 53-12 of players on this team; and so on.

Inside the housing 30, the first output section 32, which outputs a plurality of channels of audio, is arranged along an upper side 31U of the display section 31 so as to extend in a longitudinal direction and face forward (i.e., be oriented in the same direction as the display section 31). In this embodiment, the first output section 32 is configured to output three channels of audio, the three channels being an upper left channel, an upper center channel, and an upper right channel.

The first output section 32 includes loudspeakers 41, 42, and 43, each of which outputs audio of a separate channel.

Further, in this embodiment, the loudspeaker 41, which outputs audio of the upper left channel, is composed of three loudspeakers 41-1 to 41-3. The loudspeakers 41-1 to 41-3 are of the same type and form a kind of a column loudspeaker.

The loudspeaker 42, which outputs audio of the upper center channel, is composed of four loudspeakers 42-1 to 42-4. The loudspeakers 42-1 to 42-4 are also of the same type and form a kind of a column loudspeaker.

The loudspeaker 43, which outputs audio of the upper right channel, is composed of three loudspeakers 43-1 to 43-3. The loudspeakers 43-1 to 43-3 are also of the same type and form a kind of a column loudspeaker.

Moreover, inside the housing 30, the second output section 33, which outputs a plurality of channels of audio, is arranged along a lower side 31D of the display section 31 so as to extend in the longitudinal direction and face forward (i.e., be oriented in the same direction as the display section 31). In this embodiment, the second output section 33 is configured to output three channels of audio, the three channels being a lower left channel, a lower center channel, and a lower right channel. The second output section 33 includes loudspeakers 44, 45, and 46, each of which outputs audio of a separate channel.

Still further, in this embodiment, the loudspeaker 44, which outputs audio of the lower left channel, is composed of three loudspeakers 44-1 to 44-3. The loudspeakers 44-1 to 44-3 are of the same type and form a kind of a column loudspeaker.

The loudspeaker 45, which outputs audio of the lower center channel, is composed of four loudspeakers 45-1 to 45-4. The loudspeakers 45-1 to 45-4 are also of the same type and form a kind of a column loudspeaker.

The loudspeaker 46, which outputs audio of the lower right channel, is composed of three loudspeakers 46-1 to 46-3. The loudspeakers 46-1 to 46-3 are also of the same type and form a kind of a column loudspeaker.

A location of a source of sound outputted by the first output section 32 differs in distance from a location of a source of sound outputted by the second output section 33. In this embodiment, the three channels of the first output section 32 output sounds whose sources are more distant than the sources of sounds outputted from the second output section 33.

Both the left-channel loudspeakers 41 and 44 output left-channel audio. The loudspeaker 41 outputs the audio of the upper left channel, which is audio of a left channel for relatively distant sound sources, whereas the loudspeaker 44 outputs the audio of the lower left channel, which is audio of a left channel for relatively close sound sources.

Both the center-channel loudspeakers 42 and 45 output center-channel audio. The loudspeaker 42 outputs the audio of the upper center channel, which is audio of a center channel for relatively distant sound sources, whereas the loudspeaker 45 outputs the audio of the lower center channel, which is audio of a center channel for relatively close sound sources.

Both the right-channel loudspeakers 43 and 46 output right-channel audio. The loudspeaker 43 outputs the audio of the upper right channel, which is audio of a right channel for relatively distant sound sources, whereas the loudspeaker 46 outputs the audio of the lower right channel, which is audio of a right channel for relatively close sound sources.

As described above, audios of a total of six channels are outputted: an audio corresponding to relatively distant, left side sounds; an audio corresponding to relatively distant, central sounds; an audio corresponding to relatively distant, right side sounds; an audio corresponding to relatively close, left side sounds; an audio corresponding to relatively close, central sounds; and an audio corresponding to relatively close, right side sounds. This contributes to enabling the user to experience the sound with improved realism.

Note that it may be so arranged that the first output section 32 outputs sounds whose sources are relatively close and the second output section 33 outputs sounds whose sources are relatively distant. However, the user will have more natural sensation in the case where the first output section 32 outputs the sounds whose sources are relatively distant and the second output section 33 outputs the sounds whose sources are relatively close.

Note that each of the loudspeakers 41 and 46 may be composed of only one loudspeaker. In that case also, the user will be able to experience the sound with sufficient realism.

In the case where each of the loudspeakers 41 to 46 is composed of a plurality of loudspeakers to form a kind of a column loudspeaker, directivity in a direction in which the loudspeakers are arranged (i.e., the longitudinal direction of the display section 31) is narrower than directivity in a direction perpendicular to that direction (i.e., a vertical direction of the display section 31). Accordingly, the more rightward the user is relative to the display section 31, the more distant the user will feel the left side sounds are, whereas the more leftward the user is relative to the display section 31, the more distant the user will feel the right side sounds are. Thus, the user can have different sensations depending on where the user is at the time of watching, which will lead to more improved realism.

Note that each of the loudspeakers 41-1 to 46-3 may be formed by a common cone loudspeaker. In the present embodiment, the shape of each of the loudspeakers 41-1 to 46-3 as viewed from the front is assumed to be elliptical. Note, however, that the shape of each of the loudspeakers 41-1 to 46-3 as viewed from the front may be circular. Also note that another type of a loudspeaker than the cone loudspeakers may be adopted as each of the loudspeakers 41-1 to 46-3.

Both the first output section 32 and the second output section 33 are contained inside the housing 30. Therefore, in comparison to the case where a plurality of loudspeakers are prepared independently of the display and the loudspeakers are placed ahead of and behind the user, the space required for installation is reduced, resulting in an efficient use of the space. In addition, because there is no need to adjust the locations of the loudspeakers, the user is able to experience the sense of realism easily.

Figure 3:
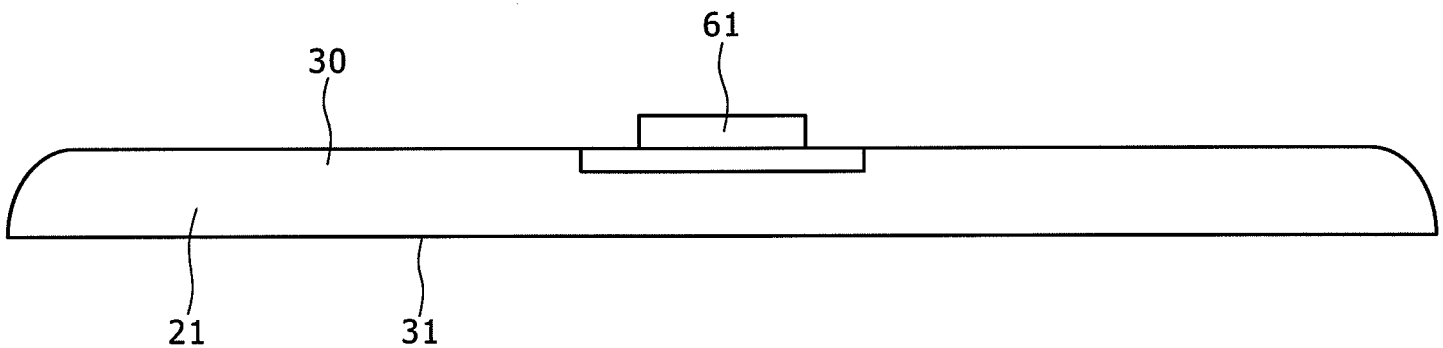
FIG. 3 is a plan view illustrating the structure of the display according to one embodiment of the present invention.
Figure 4:
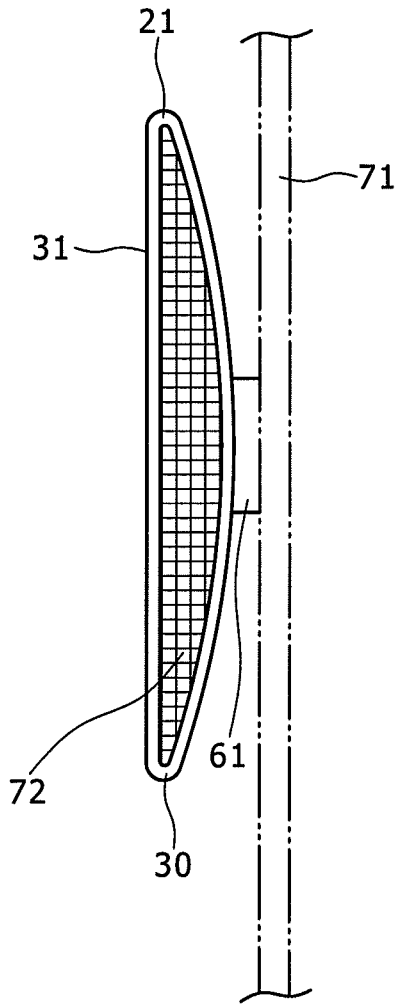
FIG. 4 is a left side view illustrating the structure of the display according to one embodiment of the present invention.

As shown in FIG. 3, a fitting part 61 is provided on a back of the display 21. The display 21 is slim, and the back of the display 21 is substantially shaped like a circular arc when viewed from a side. Thus, the display 21 has a structure suitable for installation of the display with the Scope size. Therefore, as shown in FIG. 4, the display 21 can be fit on a wall 71 such that the display 21 is fixed at a position close to the wall 71. Thus, the user will be able to use space in his or her room efficiently, because the display 21 occupies only a limited portion of free space in the room.

Figure 5:
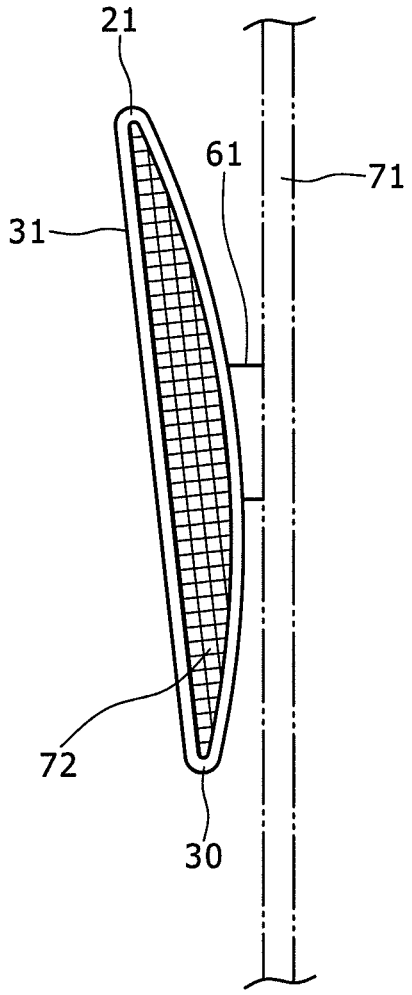
FIG. 5 is a left side view illustrating the structure of the display according to one embodiment of the present invention.

The fitting part 61 can be rotated up and down and left and right. By adjusting the position of the fitting part 61, it is possible to allow the display 21 to face downward at a slight angle to the horizontal, as shown in FIG. 5. It is also possible to rotate the display 21 horizontally as well, as needed, to allow the display 21 to face in an appropriate direction.

As shown in FIGS. 4 and 5, an exhaust fin 72 is provided on a left side of the housing 30. Heat inside the housing 30 escapes through the exhaust fin 72. Although not shown in any of the accompanying drawings, the exhaust fin 72 is provided on a right side of the housing 30 as well.

Figure 6:
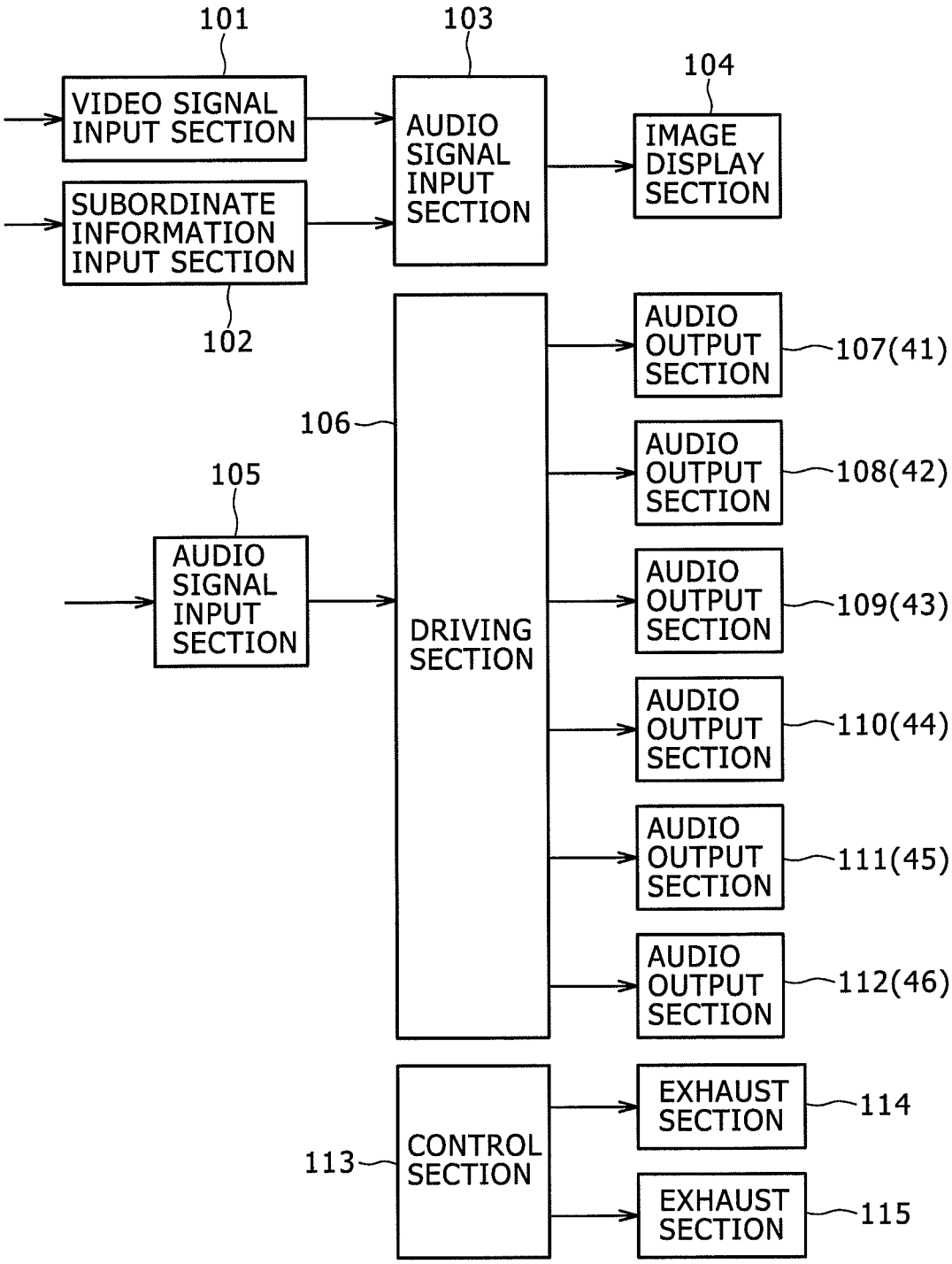
FIG. 6 is a block diagram illustrating a configuration of electrical blocks of the display according to one embodiment of the present invention.

FIG. 6 shows an electrical structure of a block 100 for driving the display 21. This block 100 may be either provided independently of the display 21 or united with the display 21 to form a television receiver.

The block 100 receives a video signal, the subordinate information, and an audio signal via a video signal input section 101, a subordinate information input section 102, and an audio signal input section 105, respectively. The video signal, the subordinate information, and the audio signal are supplied from a tuner (not shown) or an external device.

The video signal input section 101 supplies the received video signal to a driving section 103. The subordinate information input section 102 generates a video signal based on the received subordinate information, and supplies the generated video signal to the driving section 103. The driving section 103 superimposes the video signal based on the subordinate information upon the video signal supplied from the video signal input section 101, and supplies a resulting video signal to an image display section 104. The image display section 104, which corresponds to the display section 31, displays an image corresponding to the received video signal.

Upon receipt of a 6-channel audio signal, the audio signal input section 105 supplies the received 6-channel audio signal to a driving section 106. The driving section 106 separates the 6-channel audio signal into six audio signals each corresponding to a separate one of the six channels, and outputs the six audio signals to audio output sections 107 to 112. The audio output sections 107 to 112 correspond to the loudspeakers 41 to 46, respectively, and output audios corresponding to the audio signals of their respective channels.

A control section 113 is formed by a microcomputer or the like, for example. The control section 113 controls an operation of each part, and also controls exhaust sections 114 and 115 to allow the heat inside the housing 30 to escape through the left and right exhaust fins 72.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus, comprising:

a display section;

a first output section;

a second output section; and a housing containing said display section, said first output section, and said second output section, said first output section is arranged along an upper side of said display section so as to face forward and is configured to output a first plurality of audio channels, and said second output section is arranged along a lower side of said display section so as to face forward and is configured to output a second plurality of audio channels, wherein said first output section and said second output section comprise a total of six audio channels;

wherein said first plurality of audio channels of said first output section comprises: (1) an audio corresponding to relatively distant, left side sounds; (2) an audio corresponding to relatively distant, central sounds; and (3) an audio corresponding to relatively distant, right side sounds;

wherein said second plurality of audio channels of said second output section comprises: (1) an audio corresponding to relatively close, left side sounds; (2) an audio corresponding to relatively close, central sounds; and (3) an audio corresponding to relatively close, right side sounds; and wherein a location of a source of sound in the audio outputted by each of said first plurality of channels of said first output section is more distant than a location of the source of sound in the audio outputted by each related said plurality of second channels of said second output section.

2. The display apparatus according to claim 1, wherein said first output section comprises a loudspeaker configured to output left-channel audio, a loudspeaker configured to output right-channel audio, and a loudspeaker configured to output center-channel audio, and said second output section comprises a loudspeaker configured to output left-channel audio, a loudspeaker configured to output right-channel audio, and a loudspeaker configured to output center channel audio.

3. The display apparatus according to claim 1, wherein said housing has an exhaust fin provided on a side thereof.

4. The display apparatus according to claim 1, wherein said six audio channels comprise (1) an audio corresponding to relatively distant, left side sounds; (2) an audio corresponding to relatively distant, central sounds; (3) an audio corresponding to relatively distant, right side sounds; (4) an audio corresponding to relatively close, left side sounds; (5) an audio corresponding to relatively close, central sounds; and (6) an audio corresponding to relatively close, right side sounds.

5. The display apparatus according to claim 1, wherein each of said six channels is composed of a plurality of loudspeakers to form a column loudspeaker, wherein directivity in a longitudinal direction of said display section in which said loudspeakers are arranged is narrower than directivity in a direction perpendicular to said longitudinal direction.

6. The display apparatus according to claim 1, wherein said display section has an aspect ratio with a width more than twice a height.

7. The display apparatus according to claim 1, further comprising an audio signal input section which supplies a six-channel audio signal to a driving section.

8. The display apparatus according to claim 7, wherein said driving section separates said six-channel audio signal into six audio signals each corresponding to one of said six audio channels.

9. The display apparatus according to claim 8, wherein said driving section outputs said six audio signals to said output section.

* * * * *